US007703998B2

(12) United States Patent
Williams

(10) Patent No.: US 7,703,998 B2
(45) Date of Patent: Apr. 27, 2010

(54) MOUNTING ASSEMBLY FOR PRINTER

(75) Inventor: Larri B. Williams, Dayton, OH (US)

(73) Assignee: Avery Dennison Retail Information Services LLC, Miamisburg, OH (US)

( * ) Notice: Subject to any disclaimer, the term of this patent is extended or adjusted under 35 U.S.C. 154(b) by 420 days.

(21) Appl. No.: 11/606,486

(22) Filed: Nov. 30, 2006

(65) Prior Publication Data

US 2008/0131186 A1 Jun. 5, 2008

(51) Int. Cl.
*B41J 15/00* (2006.01)

(52) U.S. Cl. ..... 400/613; 400/615; 242/550; 242/558

(58) Field of Classification Search ..... 400/613, 400/615, 691, 88; 248/309.2; 242/550, 558
See application file for complete search history.

(56) References Cited

U.S. PATENT DOCUMENTS 2,250,012 A * 7/1941 Eddy ..... 400/615
4,222,532 A * 9/1980 DeLuca ..... 242/598.1
4,641,898 A * 2/1987 Horowitz et al. ..... 312/209
4,966,424 A * 10/1990 Schneider ..... 312/265.6
5,439,521 A * 8/1995 Rao ..... 118/415
5,464,289 A * 11/1995 Beaudry ..... 400/62
5,808,283 A * 9/1998 Stanton et al. ..... 235/441
6,130,699 A * 10/2000 Christensen et al. ..... 347/218
6,241,407 B1 6/2001 Huggins et al.
6,375,017 B1 4/2002 Schattner et al.
6,461,065 B2 * 10/2002 Mogi ..... 400/613
6,579,021 B2 * 6/2003 Deshayes et al. ..... 400/584
6,695,500 B2 * 2/2004 Kim et al. ..... 400/613
6,726,145 B1 * 4/2004 Kraus ..... 242/597.7
6,883,695 B2 * 4/2005 Orihara ..... 225/46
7,261,482 B2 * 8/2007 Silverbrook et al. ..... 400/621.1
2003/0107307 A1 * 6/2003 Chen ..... 312/289
2004/0158955 A1 * 8/2004 Acton et al. ..... 24/265 BC
2005/0100383 A1 * 5/2005 Clayvon et al. ..... 400/613
2006/0008312 A1 * 1/2006 Sago et al. ..... 400/642
2006/0055760 A1 * 3/2006 Cummins et al. ..... 347/104
2007/0012814 A1 * 1/2007 Burnett ..... 242/599
2007/0040059 A1 * 2/2007 Kamenstein et al. ..... 242/422
2007/0071531 A1 * 3/2007 Sugimoto et al. ..... 400/613
2007/0080256 A1 * 4/2007 Collins ..... 242/598.6
2007/0147938 A1 6/2007 Brown et al.

OTHER PUBLICATIONS

9490™ Vehicle Mount Instructions, TC 9490PVOI, © 1995 Monarch Marking Systems, Inc., 1/95 pp. 1 through 4.

* cited by examiner

*Primary Examiner*—Judy Nguyen
*Assistant Examiner*—David Banh

(57) ABSTRACT

There is disclosed a mounting assembly for mounting and securely latching a printer and a label supply roll. The mounting assembly is almost entirely constructed of fabricated sheet metal by cutting and bending. The mounting assembly is well suited to mount the printer and a supply roll in any attitude for example on a table, or on a wall or overhead in a forklift truck.

12 Claims, 7 Drawing Sheets

MOUNTING ASSEMBLY FOR PRINTER

BACKGROUND OF THE INVENTION

1. Field of the Invention

This invention relates to mounting structures to mount printers.

2. Brief Description of the Prior Art

The following documents are made of record: U.S. Pat. No. 6,241,407; and 9490™ Vehicle Mount Instructions, TC 9490PVOI, © 1995 Monarch Marking Systems, Inc. 1/95 pages 1 through 4.

SUMMARY OF THE INVENTION

There is provided an embodiment of an improved mounting assembly to mount a printer for stationary or portable use, which includes a holder for a web supply and an associated holder for a printer, and wherein the mounting assembly can be positioned in a variety of attitudes while maintaining the printer secured to the mounting assembly and holding the web supply in an operative position relative to the printer. The embodiment enables the printer to be releasably manually latched to the mounting assembly and enables the web supply to be manually latched and unlatched from the mounting assembly. It is preferred that the printer be held releasably by the printer holder so that the printer cannot be accidentally dislodged from the printer holder. A manually movable latch on the printer holder engages the printer and latches the printer in its held position. It is preferred that the web supply, which may be a roll of pressure sensitive labels, can be readily loaded onto and unloaded from the supply holder and latched, and that once so latched the web supply roll cannot be accidentally dislodged from the supply holder. It is mostly preferred that the web supply latch include a member that can be moved between a supply loading or unlatched position and a loaded supply or latched position. By way of example, a label web supply roll can be supported by a shaft and the shaft can be rotated between latched and unlatched positions.

BRIEF DESCRIPTION OF THE DIAGRAMMATIC DRAWINGS

DETAILED DESCRIPTION OF THE PREFERRED EMBODIMENTS

Figure 1:
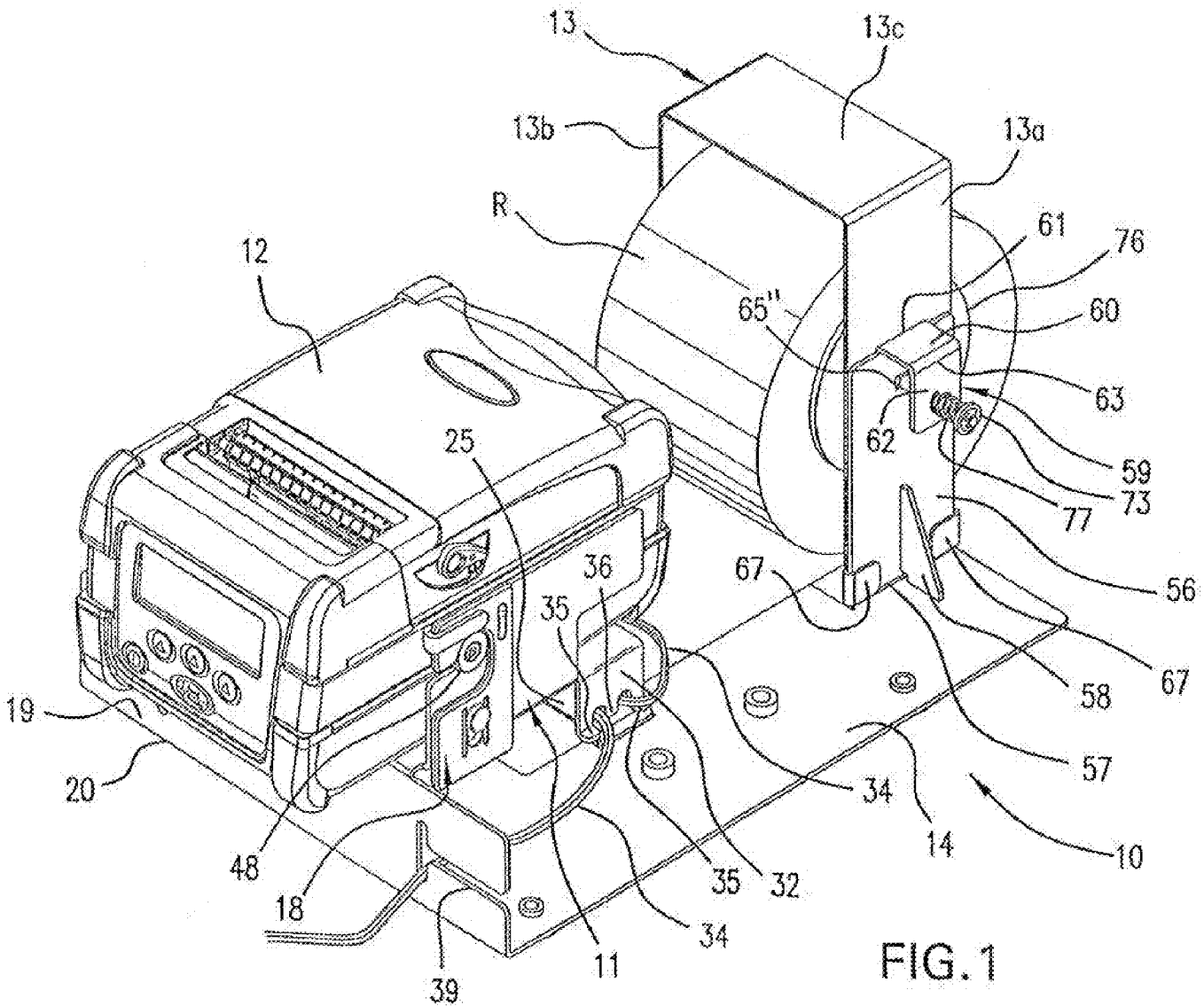
FIG. 1 is a pictorial view of a mounting assembly, and a printer and a label web supply roll mounted by the mounting assembly.
Figure 2:
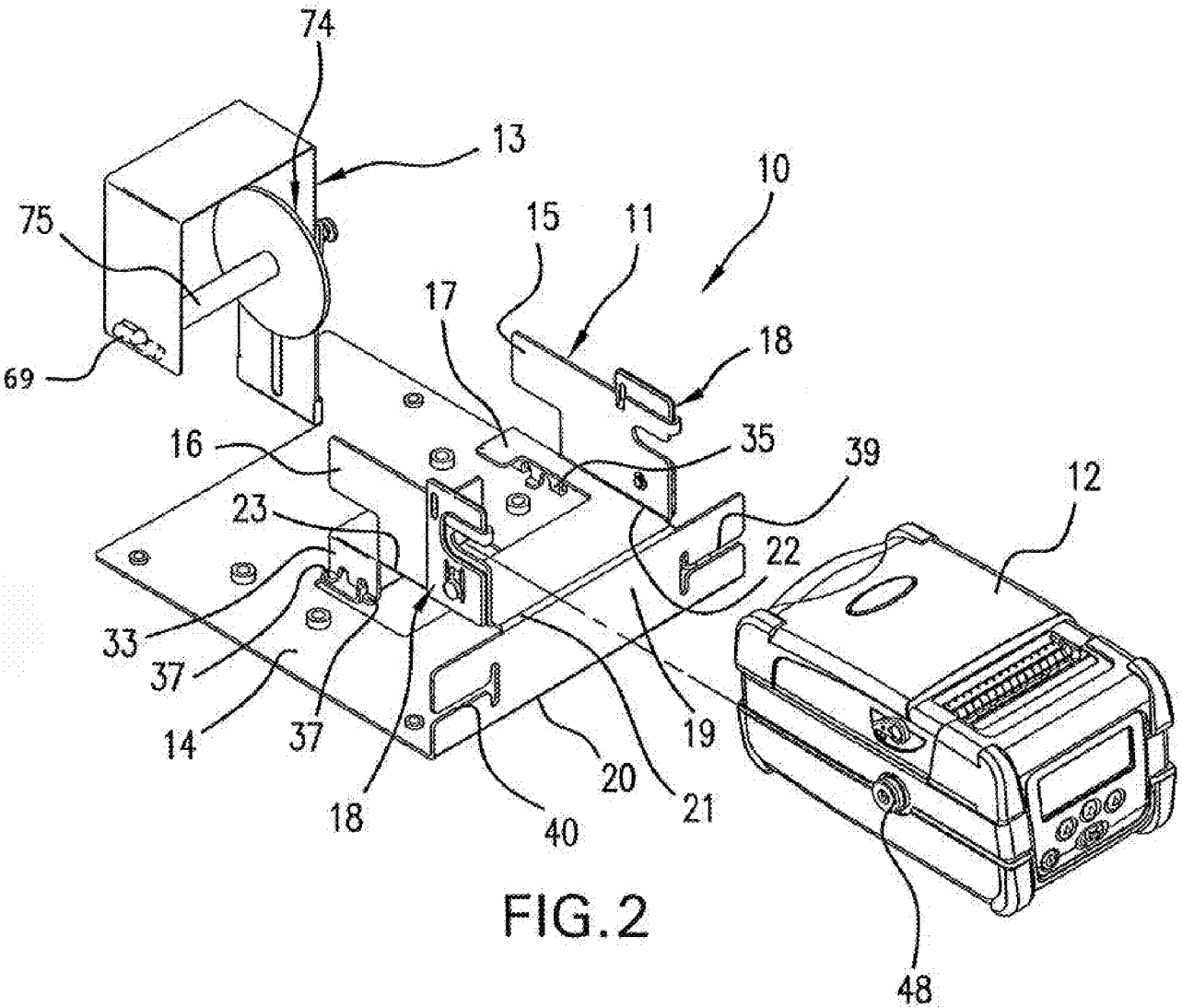
FIG. 2 is a pictorial view of the mounting assembly showing the printer exploded away and omitting the label roll shown in FIG. 1.

With reference initially to FIGS. 1 and 2, there is shown a mount or mounting assembly generally indicated at 10, including a printer mount or printer holder generally indicated at 11 for a printer 12 and supply holder generally indicated at 13. It is preferred that the holders 11 and 13 share a common base 14. FIG. 1 shows the printer 11 held by the printer holder 11 and latched in its held position while FIG. 2 shows the printer 12 aligned with the holder 11. The printer 12 is like the printer illustrated and described in U.S. Pat. No. 6,241,407, but other and different printers may be mounted on and latched to the mounting assembly 10. The disclosure of U.S. Pat. No. 6,241,407 is incorporated by reference in its entirety. As is evident from FIGS. 1 and 2, the holder 11 includes side panels 15 and 16 which straddle and confine the printer 12, and a connecting bottom or end panel 17. The printer 12 is latched to the printer holder 11 by at least one and preferably two latches generally indicated at 18.

Figure 6:
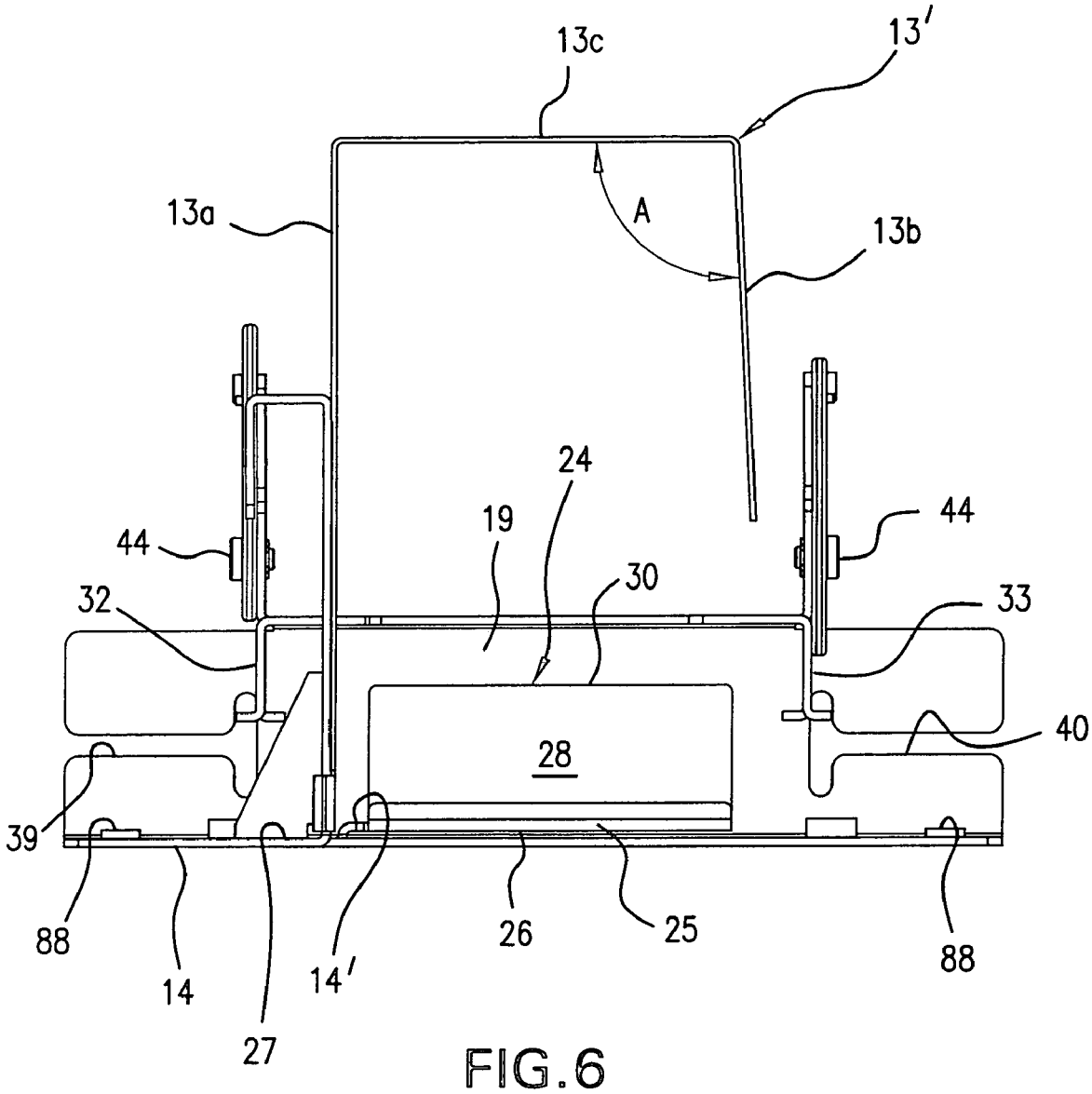
FIG. 6 is an elevational view taken along line 6-6 of FIG. 4 with certain parts omitted for clarity.
Figure 7:
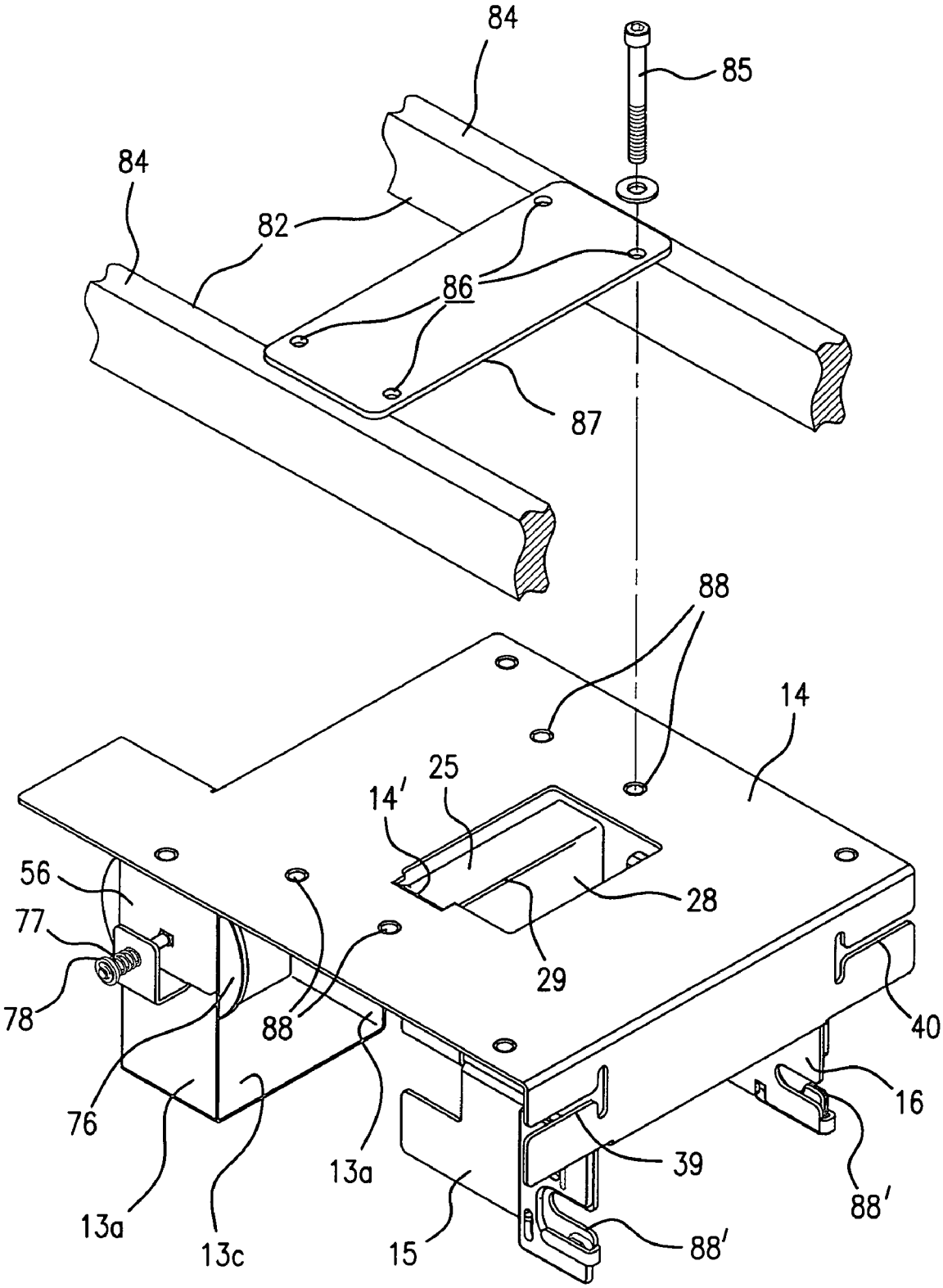
FIG. 7 is a pictorial view of the mounting assembly mounted to overhead rails of a forklift truck.

The end panel 17 is connected to the base 14 by an upstanding panel 19 which holds the end panel 17 in generally parallel spaced relation to the base 14. The panel 19 is connected to the base 14 at a bend 20 and to the end panel 17 at a bend 21. The side panels 15 and 16 are joined to the end panel 17 at bends 22 and 23. A portion of the base 14 is cut and bent at a bend 14' as best shown in FIGS. 6 and 7 to form a guide and retainer member 24 having a guide portion 25 generally parallel to the base 14. The guide portion 25 has a lower guide surface 26 which is slightly above upper surface 27 of the base 14 for guiding a web W. The member 24 has an upstanding retainer portion 28 joined to the guide portion 25 at a bend 29. Upper end 30 of the retainer portion 28 prevents a data cord connector 31 from becoming dislodged from the printer 12 by providing a stop. Thus, the unitary member 24 serves the dual function of guiding the web W and of preventing the data cord connector 31 from becoming dislodged from the printer 12 during use. As shown in FIGS. 1 through 4 and 6, there are two cord holders 32 and 33 for holding respectfully a data cord 34 and a power cord (not shown) to power the printer from a source of low voltage electricity by a transformer (not shown). The holder 32 has two outwardly extending bent tabs 35 that straddle an inwardly bent tab 36. Likewise, the holder 33 has two outwardly extending bent tabs 37 that straddle an inwardly bent tab 38. The data cord 34 is woven around the tabs 35 and 36, and likewise the power cord is woven around tabs 37 and 38. The connecting panel 19 is shown to have two T-shaped retaining slots 39 and 40. The slot 39 is for the data cord 34 and the slot 40 is for the power cord or vice versa.

The side panels 15 and 16 have respective projections 15' and 16' formed by cutting and bending out small pieces of the panels 15 and 16. The side panels 15 and 16 also have bent-over tabs 41 and 42. Identical latch members 18' of the latches 18 are captive between the panel 15 and its tab 41 and the panel 16 and its tab 42. The projections 15' and 16' extend into vertical slots 43 in the latch members 18'. The projection 15' and 16' guide the latch members 18' for vertical movement. Headed pins 44 pass through openings 45 in the latch members 18 and are secured in the side plates 15 and 16, respectively, by E-rings 46. The heads of the pins 44 also help to retain and guide the latch members 18' for vertical movement.

Figure 5:
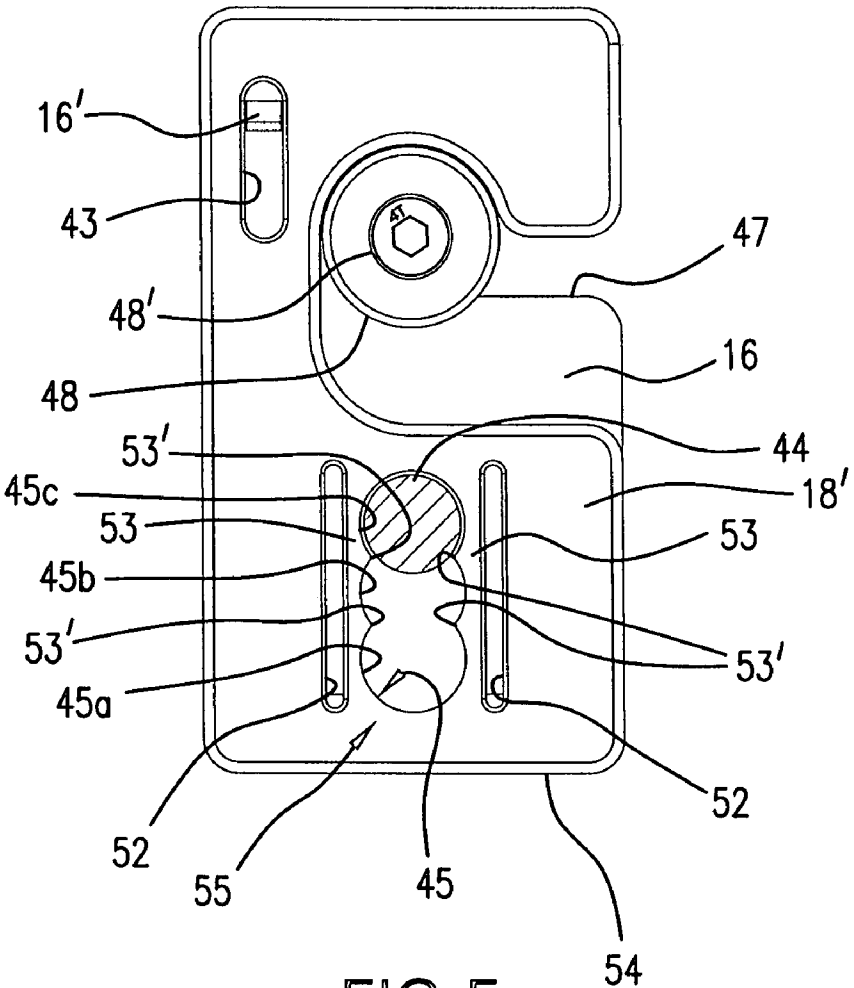
FIG. 5 is a side elevational view of one of the latches.

The side panels 15 and 16 have horizontal open-ended slots or cutouts 47 to receive shafts 48' of headed projections 48 disposed on opposite sides of the printer 12. The latch members 18' have hook-shaped configurations with enlarged openings 49 leading to throat openings 50. The throat openings 50 are large enough to receive the projections 48 when the latch members 18' are in their raised positions. In the raised positions, the projections 48 are aligned with and centered with respect to the throat openings 50. When loading the printer 12 onto the mounting assembly 10, for example upon inward movement from the FIG. 2 position to the FIG. 1 position, the projections 48 pass readily through the throat openings 50 into the openings 49. When the latch members 18' are moved vertically downward, the projections 48 are captured by the latch members 18', in particular by portions 51 which prevent the projections 48 from outward movement. The openings 45 in the latch members 18' can have at least two and preferably three lobes as best shown in FIG. 5. When the latch member 18' is in the lowered position, the pin 44 is in a lobe 45*c*. The latch member 18' is provided with two vertically extending through slots adjacent the opening 52. There is a scalloped wall 53 between each slot 52 and the opening 45. In that each latch member 18' is preferably constructed of plastics material which has a certain flexibility and resilience, when the latch member 18' is moved vertically so that the pin 44 moves toward the lobe 45*b*, the walls 53 flex outwardly away from each other until the pin 44 is embraced within the lobe 45*b*. To move the latch member 18' to where the throat opening 50 is aligned with the projection 48, the user pushes upwardly on the surface 54 until the pin 44 is received in the lobe 45*a*. The ridges 53' between the lobes 45*a* and 45*b*, and the ridges 53' between the lobes 45*b* and 45*c* releasably retain the latch members 18' in the positions to which they were moved. The construction of the flexible resilient scalloped walls 53 cooperating with the stationary pin 44 provide a detent generally indicated at 55.

The latch members 18' cooperating with their respective side panels 15 and 16, tabs 41 and 42, tabs 15' and 16' and pins 44 provide the latches 18. The latches 18, detented by detents 55, positively hold the printer 12 latched to the printer holder 11, and yet the latches 18 can be unlatched manually by sliding the latch members 18' vertically upward.

Figure 3:
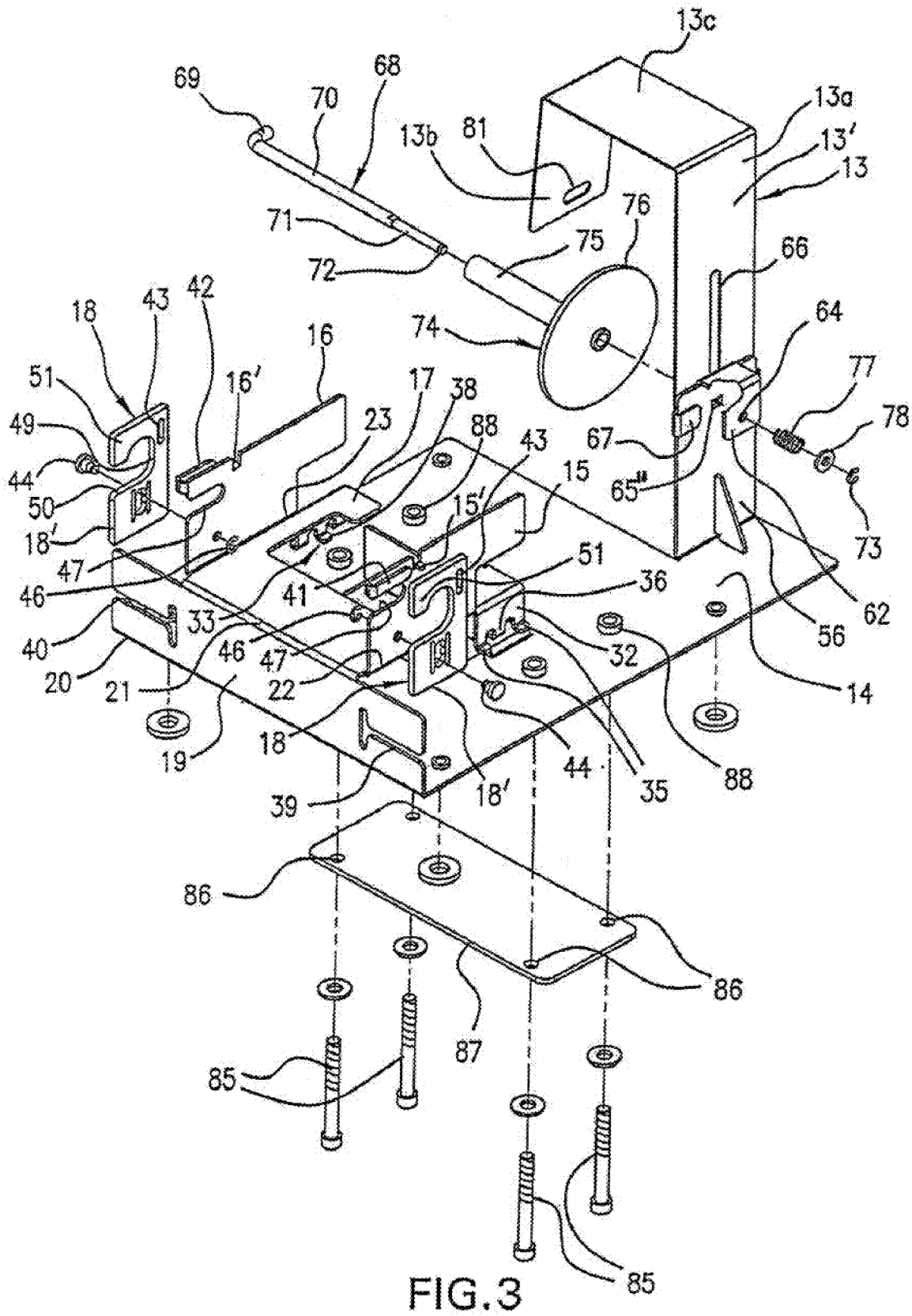
FIG. 3 is an exploded pictorial view of the mounting assembly.

With reference to the supply holder 13 shown in FIGS. 1 and 3 for example, there is shown an upright mounting member or panel 56 formed by cutting and bending up a portion of the base 14. The member 56 makes a preferably right-angled bend 57 with the base 14 so that the member 56 extends vertically. To help maintain the member 56 in position, a triangular gusset plate 58 is welded or otherwise secured to the base 14 and to the member 56. The member 56 has a standoff or integral bracket 59 which includes a horizontal portion 60 joined to the upright portion of the member 56 at a bend 61 and a vertical portion 62 joined to the horizontal portion 60 at a bend 63. The vertical portion 62 has a round hole 64. A holder member or slide 13' has a generally inverted U-shaped configuration with a leg portion 13*a* and a leg portion 13*b* joined by a connecting or bight portion 13*c*. The leg portion 13*a* has an elongate vertically extending slot 66 aligned with the holes 64 and 65". The leg portion 13*a* also has a pair of bent over tabs 67 that embrace the panel 56. A shaft or rod generally indicated at 68 has an end portion with a right-angled bend 69, a large diameter shaft portion 70 and a small diameter shaft portion 71. The shaft portion 71 has a groove 72 to receive an E-ring 73. The shaft 68 carries a roll or spool 74. The spool 74 includes a tubular hub portion 75 and a disc 76 secured to the hub portion 75. The shaft 68 extends through the hub portion 75 and the disc 76, through the slot 66, and through the holes 64 and 65". The shaft portion 71 receives a compression spring 77 and a washer or projection 78 outboard of the vertical portion 62.

Figure 3A:
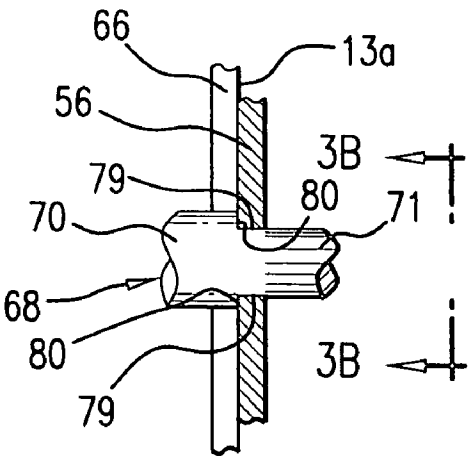
FIG. 3A is a fragmentary partly sectional view of a shaft having opposed flats and releasably locked against rotation to a mounting member.
Figure 3B:
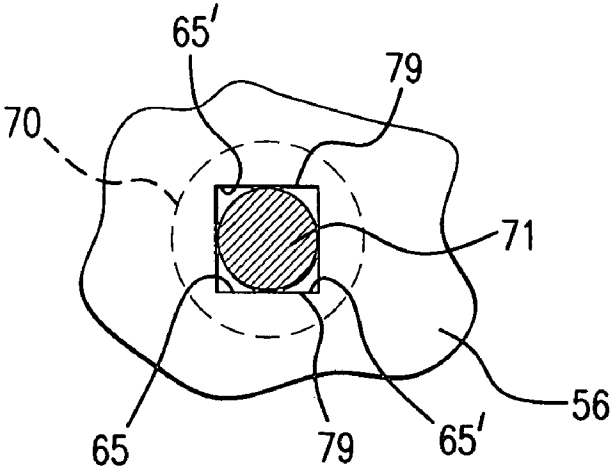
FIG. 3B is a sectional view taken along line 38-38 of FIG. 3A.
Figure 4:
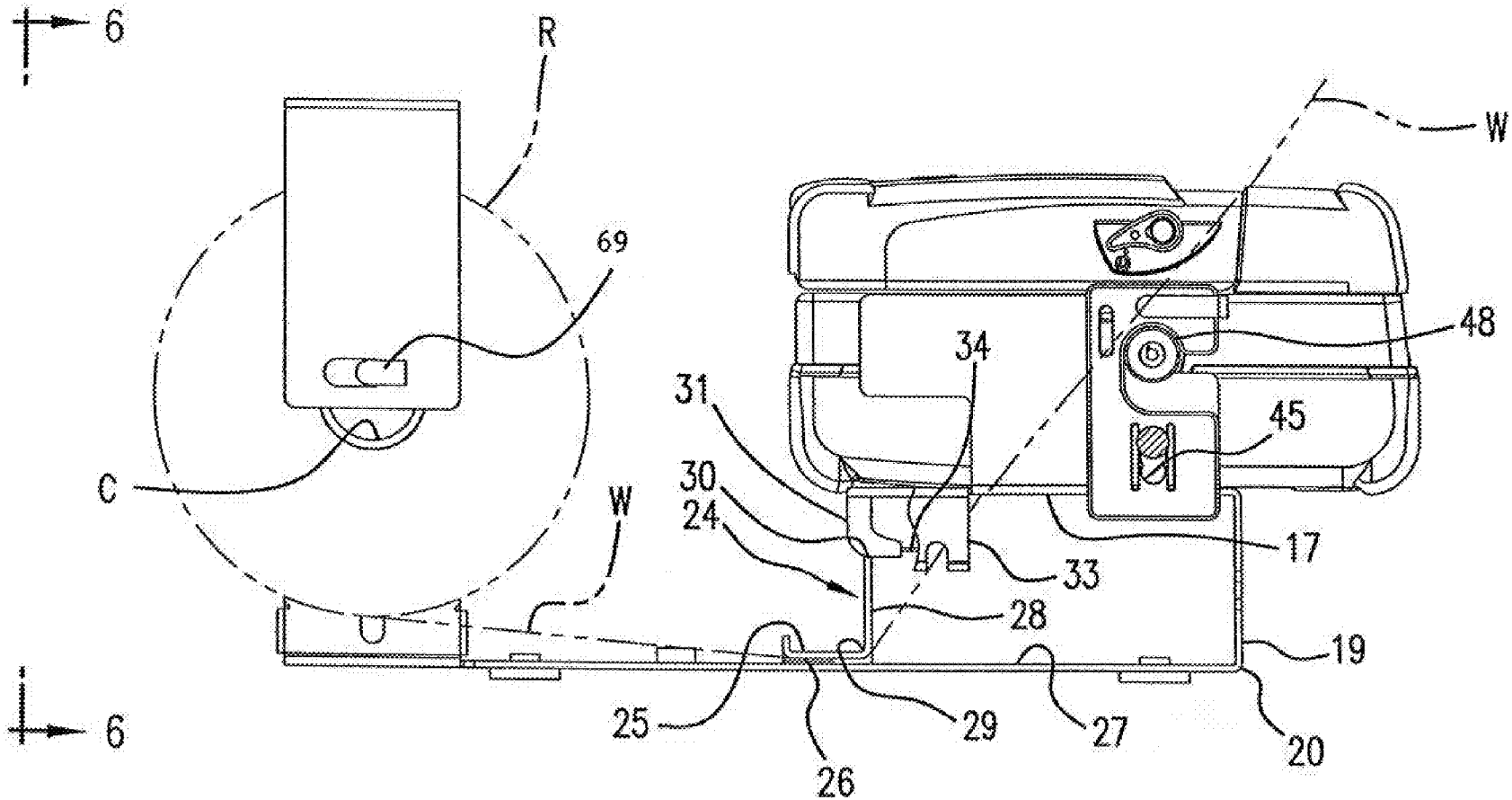
FIG. 4 is a side elevational view of the mounting assembly with the web of the label roll threaded into the printer.

FIGS. 3A and 3B show the transition between the shaft portions 70 and 71. The marginal end of the shaft portion 70 has opposed flats 79 shown to extend horizontally. The flats 79 are normally against the upper and lower flat edges 65' of the hole 65", as best shown in FIG. 3A. The compression spring urges the shaft 68 to the right as viewed in FIGS. 3 and 3A so that shoulders 80 bear against the mounting member 56.

The leg portion 70 has a horizontal elongate slot 81 with which the bent over end portions 69 extends as best shown in solid lines in FIG. 2. However, by pushing on the E-ring 78 or a suitable knob (not shown) that can be substituted for the E-ring 78, the flats 79 clear the hole 65 and the shaft 68 can be manually rotated 180 from the unlatched solid line position shown in FIG. 2 to the latched solid line position shown in FIG. 4 and the phantom line position shown in FIG. 2. When the shaft 68 has been thus rotated, the user can cease pushing on the E-ring 73 and the shaft 68 moves to the right in FIGS. 3 and 3A until the shoulders 80 abut against the mounting member 56, thereby holding the shaft 68 in the latched position. The spool 74 can rotate freely about the shaft 68. The hub portion 75 of the spool 74 readily receive the central core C of the roll R. It is preferred to have the leg portion 13*b* make an angle A of greater than 90 with respect to the bight portion 13*c* to hold the leg portion 13*b* against the end position 69. Especially with a large roll R, the holder member 13' can flex resiliently to an angle greater than angle A when loading the roll R onto the shaft portion 75.

In order to load the roll R onto the spool 74 the leg position 136 springs slightly outwardly (clockwise as viewed in FIG. 3) until the end portion 69 of the shaft 68 clears the slot 81. Thereupon, the slide 13 is raised manually, and the roll R is inserted onto the shaft portion 75 of the spool 74. Then the slide 13' is lowered until the shaft 68 is aligned with the slot 81. Thereupon, the shaft 68 can be pushed to the left as seen in FIG. 3 until the flats 79 clear the opening 65" and upon rotation of the shaft 68 to the phantom line position shown in FIG. 1, the shaft 68 is released and the spring 77 re-establishes the locking of the shaft 68 when the flats 79 cooperate with the horizontal edges of the opening 65".

The mounting assembly can be disposed in any position, such as on a table or bench, on a vertical wall, or on an overhead structure as safety rails 82 of a forklift truck. FIGS. 3 and 7 especially show how the mounting assembly may be mounted to structure such as a forklift truck. A plate 83 can be positioned against the upper surfaces 84 of the rails 82. Threaded fasteners 85 can pass through holes 86 in a sheet metal plate 87 and are threadably received in threaded holes or fasteners 88. Alternatively, the mounting assembly 10 may be bolted to a table, bench or wall.

Other embodiments and modifications of the invention will suggest themselves to those skilled in the art, and all such of these as come within the spirit of this invention are included within its scope as best defined by the appended claims.

I claim:

1. A mounting assembly for a printer, comprising:

a base, a web supply roll mounting member capable of mounting a web supply roll comprised of a printable web, the mounting member being secured to the base, an inverted U-shaped slide slidably mounted to the mounting member, the slide having a pair of first and second leg portions and a connecting bight portion, and a web supply roll supporting shaft mounted to the mounting member and capable of extending through the web supply roll and through the leg portions of the slide.

2. A mounting assembly as defined in claim 1, wherein the mounting member has spaced apart aligned holes to receive the shaft.

3. A mounting assembly as defined in claim 1, wherein the slide includes an elongate slot, wherein the mounting member has spaced apart aligned holes, and wherein the shaft is mounted in the holes and extends through the slot.

4. A mounting assembly as defined in claim 1, wherein the first leg portion is slidably mounted on the mounting member, and the second leg portion being deflectable to enable the supporting shaft and the second leg portion to be moved apart to enable a supply roll to be loaded onto the supporting shaft.

5. A mounting assembly as defined in claim 2, including a compression spring on the shaft, a projection on the shaft, the spring being between the mounting member and the projection, compression of the spring enabling the shaft to be rotated selectively to latch and unlatch the shaft from the second leg portion.

6. A mounting assembly as defined in claim 5, wherein one of the holes is non-circular and a portion of the shaft is non-circular, and wherein the shaft is held against rotation as the spring seats the non-circular portion of the shaft in the non-circular hole.

7. A mounting assembly as defined in claim 6, wherein the second leg portion has a slot, the shaft has a lateral portion which can be aligned with the slot in one rotational position of the shaft and can be out of alignment with the slot in another rotational position of the shaft to selectively unlatch and latch the second leg portion with the shaft.

8. A mounting assembly as defined in claim 1, wherein the base is constructed of sheet metal and the mounting member is joined to the base at a bend in the sheet metal.

9. A mounting assembly as defined in claim 1, including at least one latch capable of latching a printer to the base.

10. A mounting assembly as defined in claim 9, a printer holder on the base, and wherein the at least one latch is disposed on the printer holder.

11. A mounting assembly as defined in claim 10, wherein the printer holder provides a web path for the web from the web supply roll.

12. A mounting assembly as defined in claim 1, including a printer holder on the base, and wherein there is a path for the web from the supply roll to the printer.

* * * * *